US011732514B2

(12) United States Patent
Taurasi

(10) Patent No.: US 11,732,514 B2
(45) Date of Patent: Aug. 22, 2023

(54) CLOSURE LATCH ASSEMBLY WITH A POWER RELEASE MECHANISM AND AN INSIDE HANDLE RELEASE MECHANISM

(71) Applicant: Magna Closures Inc., Newmarket (CA)

(72) Inventor: Marco Taurasi, Leghorn (IT)

(73) Assignee: MAGNA CLOSURES INC., Newmarket (CA)

( * ) Notice: Subject to any disclaimer, the term of this patent is extended or adjusted under 35 U.S.C. 154(b) by 198 days.

(21) Appl. No.: 17/384,948

(22) Filed: Jul. 26, 2021

(65) Prior Publication Data

US 2021/0355719 A1 Nov. 18, 2021

Related U.S. Application Data

(63) Continuation of application No. 15/997,066, filed on Jun. 4, 2018, now Pat. No. 11,072,950.

(60) Provisional application No. 62/516,354, filed on Jun. 7, 2017.

(51) Int. Cl.

| | |
|---|---|
| ***E05B 81/90*** | (2014.01) |
| ***E05B 85/00*** | (2014.01) |
| ***E05B 77/24*** | (2014.01) |
| ***E05B 81/16*** | (2014.01) |

(Continued)

(52) U.S. Cl.

CPC ..... *E05B 81/90* (2013.01); *E05B 77/245* (2013.01); *E05B 81/16* (2013.01); *E05B 85/01* (2013.01); *E05B 77/30* (2013.01); *E05B 81/06* (2013.01)

(58) Field of Classification Search

CPC ..... Y10T 292/1082; Y10T 292/1047; Y10T 292/308; Y10S 292/23; E05B 81/14; E05B 81/16; E05B 81/00; E05B 81/04; E05B 81/06; E05B 81/90; E05B 77/22; E05B 77/24; E05B 77/245; E05B 77/30; E05B 85/01; E05B 85/00; E05B 85/16; E05B 17/0029

See application file for complete search history.

(56) References Cited

U.S. PATENT DOCUMENTS

| | | | |
|---|---|---|---|
| 8,141,916 | B2 | 3/2012 | Tomaszewski et al. |
| 8,764,075 | B2 | 7/2014 | Taurasi et al. |

(Continued)

FOREIGN PATENT DOCUMENTS

| | | | |
|---|---|---|---|
| EP | 1320652 | B1 | 11/2005 |
| EP | 2820216 | B1 | 4/2018 |

*Primary Examiner* — Christine M Mills
*Assistant Examiner* — Yahya Sidky
(74) *Attorney, Agent, or Firm* — Dickinson Wright PLLC

(57) ABSTRACT

A closure latch assembly for a motor vehicle closure system includes a power release mechanism and an inside handle release mechanism mechanically connected to an inside door handle. The power release mechanism is used to shift the inside handle release mechanism from a normally Disengaged operating state to an Engaged operating state. In the Disengaged state, the inside handle release mechanism is uncoupled from the latch release chain of components to prevent latch release via actuation of the inside door handle. In the Engaged state, the inside handle release mechanism is coupled for the latch release chain of components to permit latch release via actuation of the inside door handle. The power release mechanism only shifts the inside release mechanism from its Disengaged state into its Engaged state in the event of an emergency condition.

27 Claims, 11 Drawing Sheets

(51) Int. Cl.
*E05B 81/06* (2014.01)
*E05B 77/30* (2014.01)

(56) References Cited

U.S. PATENT DOCUMENTS

| | | | | |
|---|---|---|---|---|
| 2010/0235058 | A1* | 9/2010 | Papanikolaou | E05B 81/64 701/49 |
| 2010/0244466 | A1 | 9/2010 | Tomaszewski | |
| 2016/0002959 | A1 | 1/2016 | Javadzadeh et al. | |
| 2016/0362916 | A1 | 12/2016 | Tomaszewski | |
| 2017/0074008 | A1 | 3/2017 | Marlia et al. | |
| 2017/0107747 | A1 | 4/2017 | Dente et al. | |
| 2017/0314297 | A1* | 11/2017 | Taurasi | E05B 77/30 |
| 2018/0066457 | A1 | 3/2018 | Erices et al. | |
| 2019/0271180 | A1* | 9/2019 | Sardelli | E05B 81/14 |
| 2021/0108451 | A1 | 4/2021 | Dente et al. | |

* cited by examiner

CLOSURE LATCH ASSEMBLY WITH A POWER RELEASE MECHANISM AND AN INSIDE HANDLE RELEASE MECHANISM

CROSS-REFERENCE TO RELATED APPLICATIONS

This application is a continuation of U.S. patent application Ser. No. 15/997,066 filed on Jun. 4, 2018, which claims priority to and the benefit of U.S. Provisional Application No. 62/516,354 filed Jun. 7, 2017. The entire disclosure of each of the above applications is incorporated herein by reference.

FIELD

The present disclosure relates generally to closure latch assemblies for motor vehicle closure systems. More specifically, the present disclosure relates to a closure latch assembly for a vehicle door equipped with a power release mechanism and an emergency inside handle release mechanism.

BACKGROUND

This section provides background information related to the present disclosure which is not necessarily prior art.

Passive entry systems for vehicles are provided on some vehicles to permit a vehicle user who is in possession of a key fob to simply pull the door handle and open the door without the need to introduce a key into a keyhole in the door. The key fob is typically equipped with an electronic device that communicates with the vehicle's on-board control system to authenticate the user. When the user actuates the unlock switch on the key fob and subsequently pulls the outside door handle to indicate that he/she wishes entry into the vehicle, an electric actuator of a power-operated latch release mechanism associated with a door-mounted closure latch assembly is actuated to release a latch mechanism for allowing the door to be opened. The outside door handle may also be equipped with a switch that triggers actuation of the electric actuator when the key fob is detected in the user's possession. In some closure latch assemblies, the latch mechanism may also be manually released from inside the vehicle since the inside door handle is connected to the latch mechanism via an inside handle release mechanism associated with the closure latch assembly. In some jurisdictions, however, there are regulations that govern the degree of connection provided by the inside handle release mechanism between the inside door handle and the latch mechanism (particularly for a rear door, where children may be the occupants).

Many modern closure latch assemblies provide one or more power-operated functions including power release, power lock, power child lock, and power cinch or soft-close features. Loss of power to the closure latch assembly may render such power-operated functions inoperable. To avoid entrapment within the passenger compartment upon loss of the power release and/or power lock functions, for example, most closure latch assemblies have the inside handle release mechanism configured to be activated via the inside door handle to release the latch mechanism and open the vehicle door. Typically, such "backup" latch release arrangements, particularly those associated with lost power conditions, are complicated and the actuation requirements (i.e. double pull) may not be intuitive to the vehicle occupant.

Accordingly, while commercially-available powered closure latch assemblies are satisfactory to meet all operational and regulatory requirements, a recognized need exists to advance the technology and provide optimized closure latch assemblies having reduced complexity and packaging while providing both the desired power-operated functions and emergency inside release function previously mentioned.

SUMMARY

This section provides a general summary of the disclosure and is not intended to be interpreted as a comprehensive and exhausting listing of its full scope or all of its features and advantages.

It is an aspect of the present disclosure to provide a closure latch assembly for a vehicle door having a power release mechanism and an inside handle release mechanism.

It is a related aspect of the present disclosure to shift the inside handle release mechanism between a Disengaged operating state for preventing release of the closure latch assembly via actuation of an inside door handle and an Engaged operating state for permitting release of the closure latch assembly via actuation of the inside door handle. The power release mechanism is used to shift the inside handle release mechanism from its Disengaged state into its Engaged state in response to the occurrence of certain emergency conditions.

In another related aspect, the power release mechanism utilizes a three position power release gear operable in a first or "released" position to provide a power release function, in a second or "central-home" position to establish the Disengaged state for the inside handle release mechanism, and in a third or "unlocked" position to establish the Engaged state for the inside handle release mechanism to provide an emergency release function.

In accordance with these and other aspects, the present disclosure is directed to a closure latch assembly having a latch mechanism, a power release mechanism, and an inside handle release mechanism. The latch mechanism includes a ratchet and a pawl. The ratchet is moveable between a striker release position and a striker capture position and is biased by a ratchet spring toward its striker release position. The pawl is moveable between a ratchet holding position whereat the pawl holds the ratchet in its striker capture position and ratchet releasing position whereat the pawl permits the ratchet to move to its striker release position. The pawl is biased by a pawl spring toward its ratchet holding position.

The power release mechanism includes a power release motor, a power release gear driven by the power release motor, a gear lever, and an actuator lever. The actuator lever is moveable between a non-actuated position whereat the pawl is located in its ratchet holding position and an actuated position whereat the actuator lever causes the pawl to move into its ratchet releasing position. The actuator lever is biased by an actuator lever spring toward its non-actuated position. The power release gear is moveable via the power release motor in a first or "power releasing" direction from its central-home position to its released position for causing a release cam on the power release gear to move the actuator lever from its non-actuated position to its actuated position. The power release gear is also moveable via the power release motor in a second or "unlocking" direction from its central-home position to its unlocked position. The gear lever engages a gear lever cam on the power release gear and is biased by a gear lever spring to urge the power release gear to move from its released position toward its central-home position.

The inside handle release mechanism includes an emergency lever and a link lever. The emergency lever is mechanically connected to the inside door handle and is moveable between a home position and a pulled position in response to movement of the inside door handle between a rest position and an actuated position. The link lever is operatively coupled to the emergency lever and is moveable between an uncoupled position and a coupled position. The link lever is biased toward its coupled position. To establish the Disengaged operating state of the inside handle release mechanism, the link lever is held in its uncoupled position by a link lever cam formed on the power release gear when the power release gear is located in its central-home position such that a first drive member formed on the link lever is disengaged from a second drive member extending from the actuator lever. With the link lever mechanically disconnected from the actuator lever, movement of the link lever in response to movement of the emergency lever from its home position to its pulled position does not cause corresponding movement of the actuator lever from its non-actuated position to its actuated position. However, movement of the power release gear from its central-home position to its unlocked position disengages the link lever from the link lever cam and permits the link lever to move to its coupled position. With the link lever located in its coupled position, the first drive member thereon is aligned with and drivingly connected to the second drive member on the actuator lever. As such, the link lever is operatively connected to the actuator lever when located in its coupled position such that movement of the emergency lever from its home position to its pulled position in response to movement of the inside door handle from its rest position to its actuated position causes the link lever to move the actuator lever from its non-actuated position to its actuated position. The power release gear is only moved from its central-home position to its unlocked position by the power release motor in response to detection of certain emergency conditions (i.e., a low power or no power condition, etc.) so as to shift the inside handle release mechanism from its Disengaged operating state into its Engaged operating state to permit mechanical release of the closure latch assembly. An auxiliary or reserve power source associated with the closure latch assembly is used to energized the power release motor for driving the power release gear from its central-home position to its unlocked position.

Further areas of applicability will become apparent from the description provided hereon. The description and specific examples in this summary are intended for purposes of illustration only and are not intended to limit the scope of the present disclosure.

BRIEF DESCRIPTION OF THE DRAWINGS

The drawings described herein are provided for illustrating selected, non-limiting embodiments of the present disclosure. The present disclosure will now be described by way of example with reference to the attached drawings, in which.

Corresponding reference numerals are used throughout all of the drawings to identity common components.

DETAILED DESCRIPTION

Figure 1:
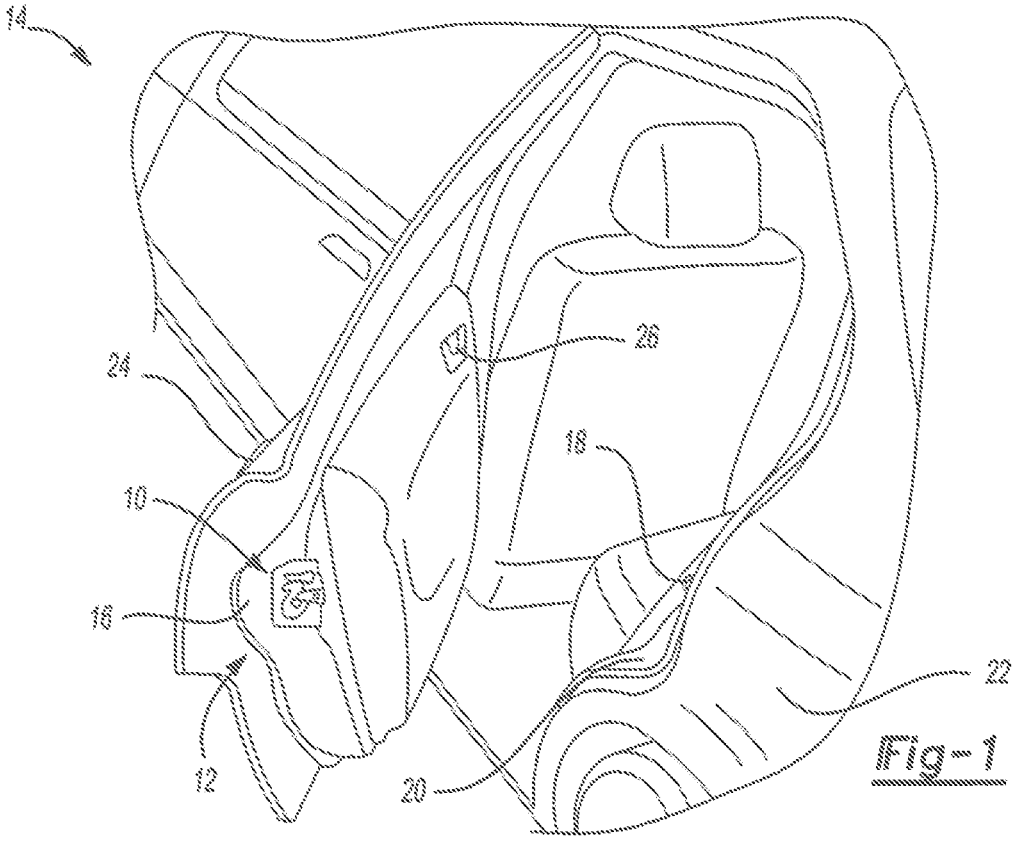
FIG. 1 is a partial isometric view of a motor vehicle having a passenger door equipped with a closure latch assembly constructed in accordance with the teachings of the present disclosure.

In general, example embodiments of closure latch assemblies constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

With reference to FIG. 1, a closure latch assembly 10 for a passenger door 12 of a motor vehicle 14 is shown positioned along a rear edge portion 16 of door 12 and is configured to releaseably engage a striker 18 secured in a door opening 20 formed in the vehicle's body 22 in response to movement of door 12 from an open position (shown) to a closed position. Door 12 includes an outside door handle 24 and an inside door handle 26, both of which are operatively coupled (i.e., electrically and/or mechanically) to closure latch assembly 10.

Figure 2:
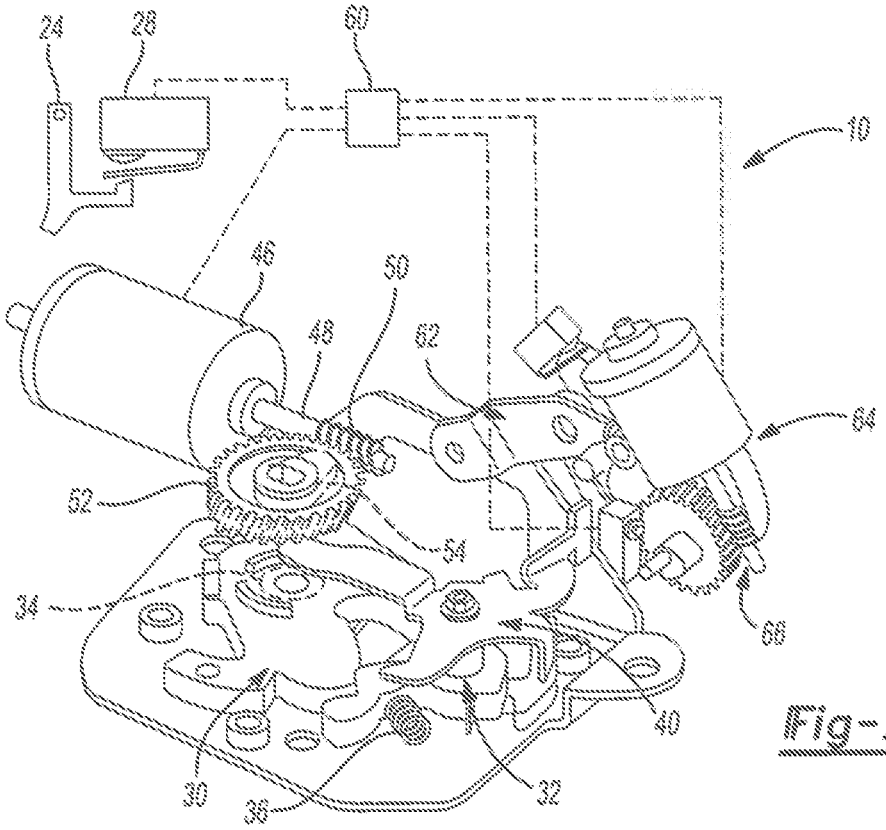
FIG. 2 is an isometric view of a closure latch assembly illustrating the components of a latch mechanism and a latch release mechanism associated with the present disclosure.

Referring now to FIG. 2, a non-limiting embodiment of closure latch assembly 10 is shown to generally include a latch mechanism, a latch release mechanism, a power release mechanism, an inside handle release mechanism, and a power lock mechanism. The latch mechanism includes a ratchet 30 and a pawl 32. Ratchet 30 is moveable between a first or "striker capture" position whereat ratchet 30 retains striker 18 and a second or "striker release" position whereat ratchet 30 permits release of striker 18. A ratchet biasing member, such as a torsion spring 34, biases ratchet 30 toward its striker release position. Pawl 32 is moveable relative to ratchet 30 between a first or "ratchet holding" position whereat pawl 32 holds ratchet 30 in its striker capture and a second or "ratchet releasing" position whereat pawl 32 permits ratchet spring 34 to forcibly move ratchet 30 from its striker capture position to its striker release position. A pawl biasing member, such as a coil spring 36, biases pawl 32 toward its ratchet holding position.

The latch release mechanism includes, among other things, a release lever 40 operatively connected to pawl 32 and which is moveable between a first or "pawl release" position whereat release lever 40 causes pawl 32 to move to its ratchet releasing position and a second or "home" position whereat release lever 40 permits pawl 32 to be maintained in its ratchet holding position. A release lever biasing member, such as a release lever spring (not shown), is provided to bias release lever 40 to its home position. Release lever 40 may be moved from its home position to its pawl release position by several components such as, for example, the power release mechanism and the inside handle release mechanism.

The power release mechanism includes, among other things, a power release electric motor 46 having a rotatable motor output shaft 48, a power release worm gear 50 secured to motor output shaft 48, a power release gear 52, and a power release cam 54. Power release cam 54 is connected for common rotation with power release gear 52 and is rotatable between a first or "rest" position and a second or "release" position. Power release gear 52 is driven by worm gear 50 and, in turn, drives power release cam 54 which controls movement of release lever 40 between its home and pawl release positions. Specifically, when power release cam 54 is located in its rest position, release lever 40 is maintained in its home position. However, rotation of power release cam 54 to its release position causes release lever 40 to move to its pawl release position, thereby providing a power releasing operation of the latch mechanism.

The power release mechanism may be used as part of a passive entry system. When a person approaches vehicle 14 with an electronic key fob and actuates outside door handle 24, an electronic latch release system associated with vehicle 14 senses both the presence of the key fob and that outside door handle 24 has been actuated (e.g., via communication between a switch 28 and an electronic control unit (ECU) 60 that at least partially controls the operation of closure latch assembly 10. In turn, ECU 60 actuates the power release mechanism to cause power release motor 46 to rotate power release cam 54 from its rest position into its release position for releasing the latch mechanism and unlatching closure latch assembly 10 so as to open vehicle door 12. Power release motor 46 thereafter causes power release cam 54 to rotate from its release position to its rest position for resetting the power release mechanism.

The inside handle release mechanism is shown to include an inside release lever 62 that is operatively coupled to inside handle 26 and which permits release of the latch mechanism from inside the passenger compartment of motor vehicle 14 under certain conditions. The power lock mechanism is shown to include, amongst other things, a power lock actuator 64 and a lock mechanism 66.

Referring now to FIGS. 3-12, the components associated with a non-limiting embodiment of a power release mechanism 100 and an inside handle release mechanism 200 are shown and which are adapted for use with closure latch assembly 10. FIGS. 3A and 3B illustrate power release mechanism 100 to generally include a power release actuator 102, a power release gear 104, and a gear lever 106. Power release actuator 102 is comprised of an electric motor or power release motor 110 having a motor shaft 112 and an output gear shown as worm gear 114. Electric motor 110 is controlled by ECU 60 for rotatably driving motor shaft 112. Power release gear 104 is configured to include external gear teeth 116 meshed with the threads of worm gear 114, a release cam 118 formed on a first face surface 120, and a gear lever cam 122 formed on a second face surface 124. Power release gear 104 is supported for rotation about a gear axis "A".

Gear lever 106 is supported for pivoted movement about a lever axis "B" and is formed to include a drive lug segment 130 engaging gear lever cam 122 and a stop lug segment 132. A gear lever spring 134 is configured to bias drive lug segment 130 against gear lever cam 122 and to bias stop lug segment 132 against a stationary hard stop surface 136. Additionally, a power release stop sensor 140 is located adjacent to power release gear 104 for detecting the position of a stop cam 142 extending from second face surface 124 on power release gear 104. The power release gear position signal generated by power release stop sensor 140 is communicated to ECU 60. Power release gear 104 also includes a raised link lever cam 144 extending from first face surface 120, the function of which will be described hereinafter.

Power release gear 104 is rotatable about axis "A" in a "power releasing" direction from a first or "central-home" position to a second or "released" position. Opposite rotation of power release gear 104 in a "power resetting" direction functions to return power release gear 104 from its released position to its central-home position. In addition, power release gear 104 is rotatable in an "unlocking" direction from its central-home position to a third or "unlocked" position. Opposite rotation of power release gear 104 in an "unlock resetting" direction functions to return power release gear 104 from its unlocked position to its central-home position. Thus, a three (3) position power release gear 104 is associated with power release mechanism 100. As will be detailed, power release mechanism 100 is defined as operating in a Neutral state when power release gear 104 is located in its central-home position, as operating in a Released state when power release gear 104 is located in its released position, and as operating in an Unlocked state when power release gear 104 is located in its unlocked position. Each of these three distinct operating states provides a different functionality hereinafter described.

Figure 3B:
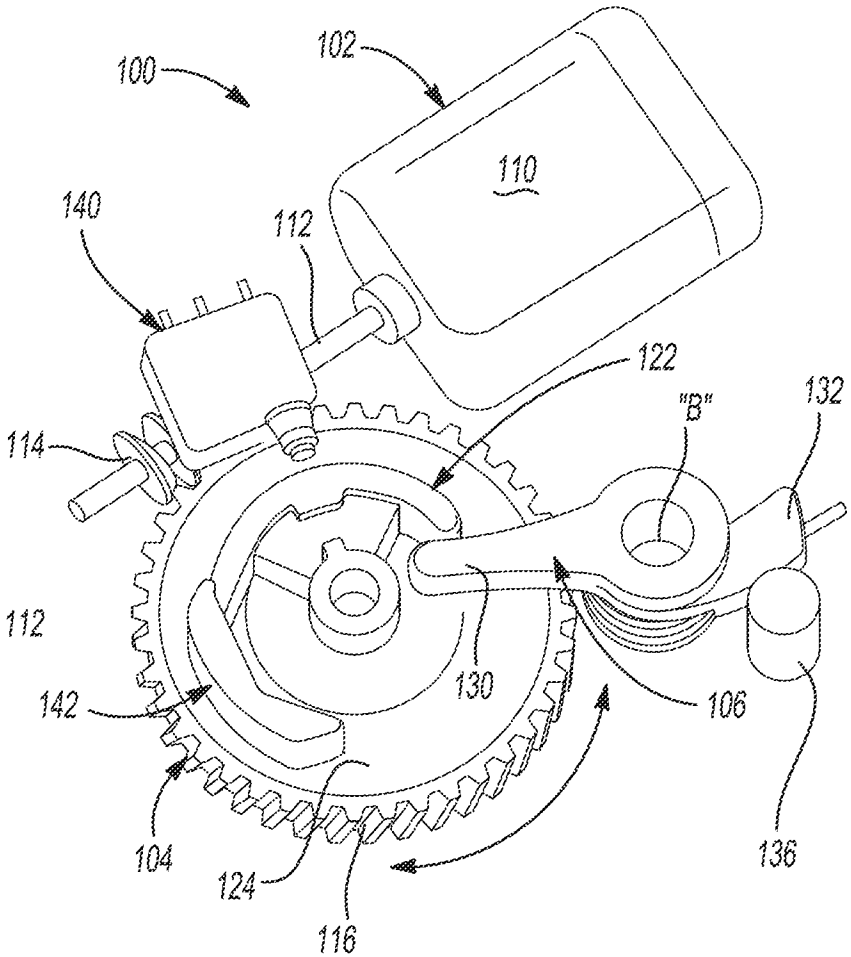
FIG. 3A is a top isometric view and FIG. 3B is a bottom isometric view of a power release mechanism associated with the closure latch assembly of the present disclosure.
Figure 3A:
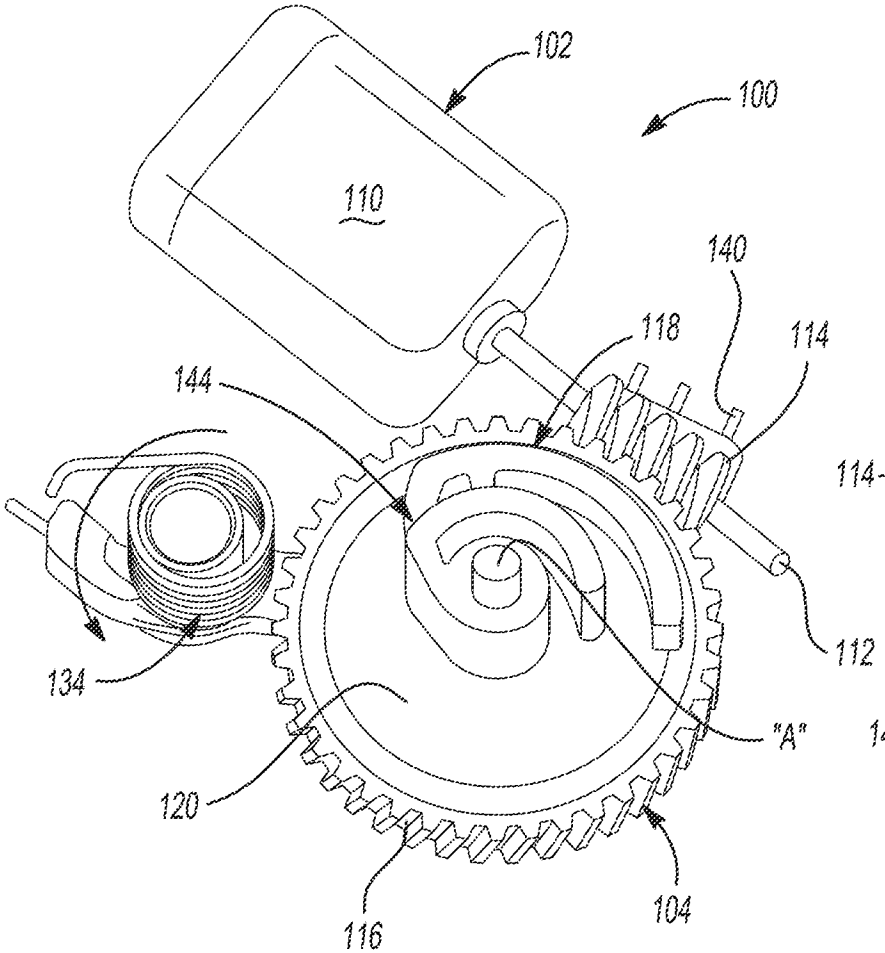
Figure 4B:
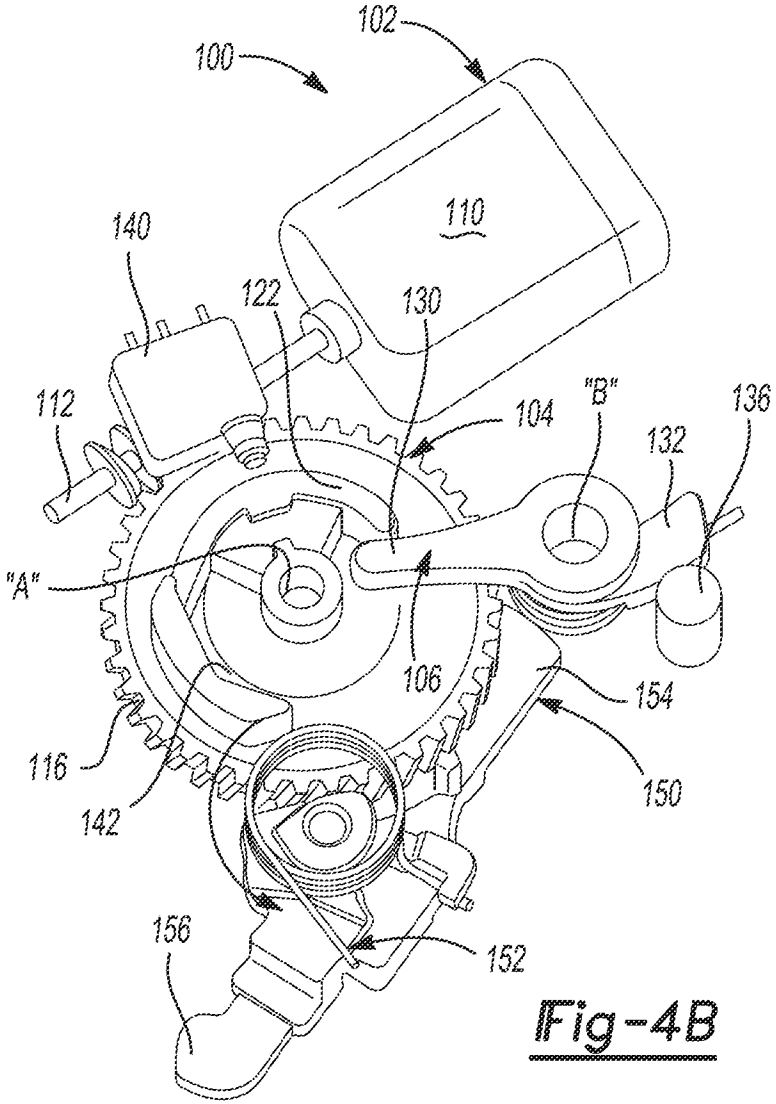
FIGS. 4A and 4B are built-up versions of FIGS. 3A and 3B, respectively, showing additional components of the power release mechanism.
Figure 4A:
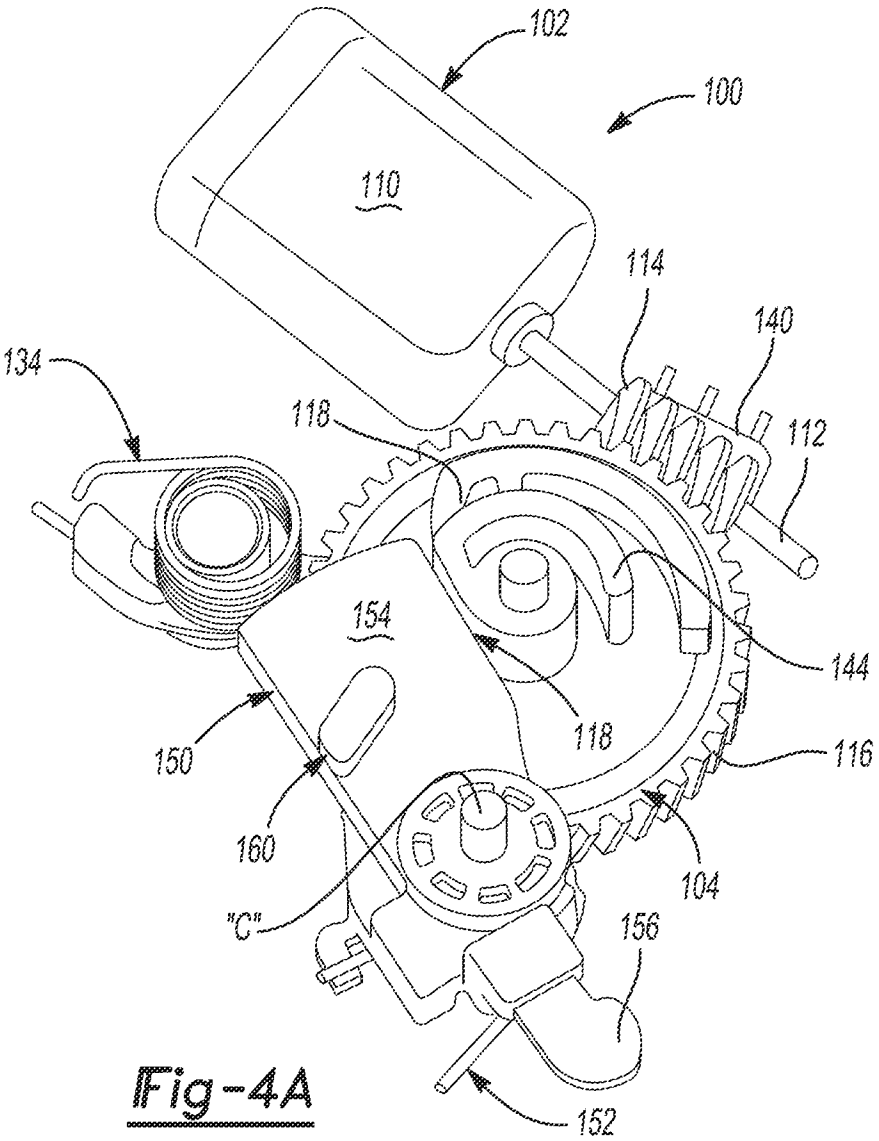

Referring now to FIGS. 4A and 4B, additional components of power release mechanism 100 are shown built upon the components shown in FIGS. 3A to 3B, respectively and include an actuator lever 150 and an actuator lever spring 152. Actuator lever 150 is pivotably moveable about an actuator lever axis "C" and includes a plate segment 154 and an actuator lug segment 156. Actuator lug segment 156 is positioned to selectively engage release lever 40 of the latch release mechanism. In particular, movement of actuator lever 150 from a first or "non-actuated" position to a second or "actuated" position causes actuator lug segment 156 to forcibly move release lever 40, in opposition to the biasing of release lever spring 42, from its home position to its pawl release position. As previously noted, such movement of release lever 40 results in movement of pawl 32 to its ratchet releasing position for releasing the latch mechanism. Actuator lever spring 152 is operable to normally bias actuator lever 150 toward its non-actuated position. A first drive member, hereinafter referred to as drive lug 160, extends from plate segment 154 of actuator lever 150, the function of which is described hereinafter.

Figure 5B:
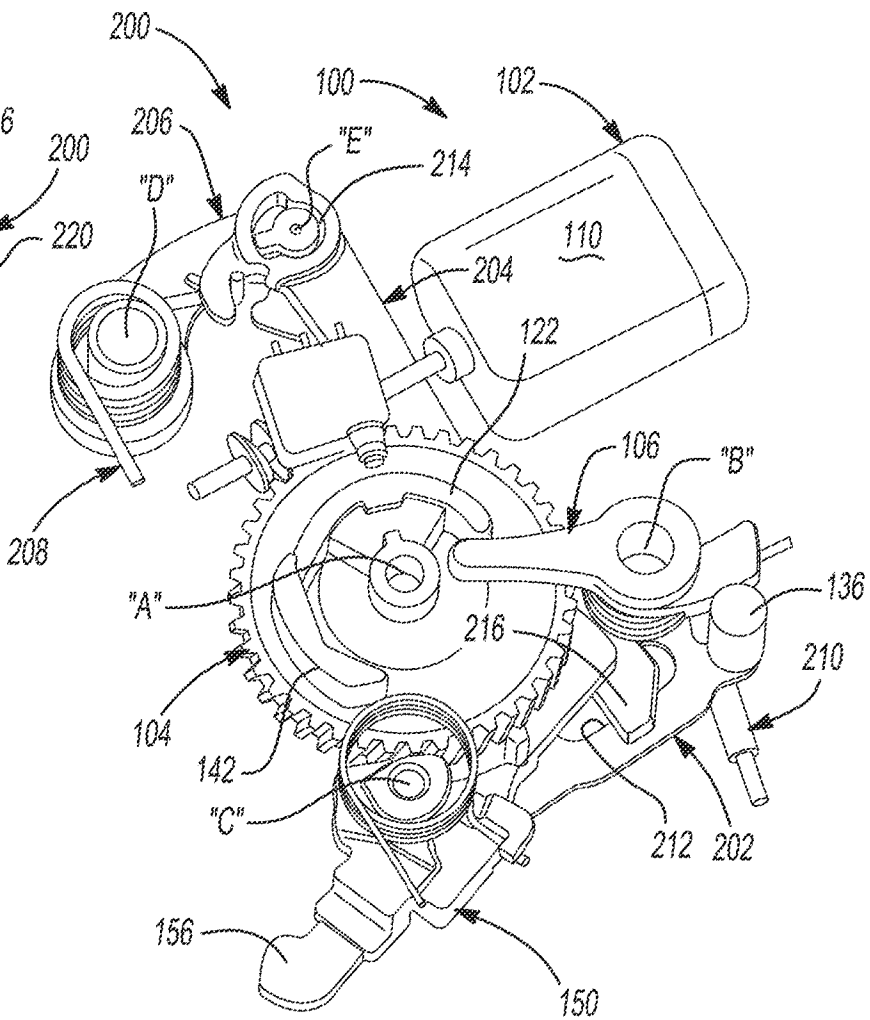
FIGS. 5A and 5B are built-up versions of FIGS. 4A and 4B, respectively, now showing additional components of an inside handle release mechanism associated with the closure latch assembly of the present disclosure.
Figure 5A:
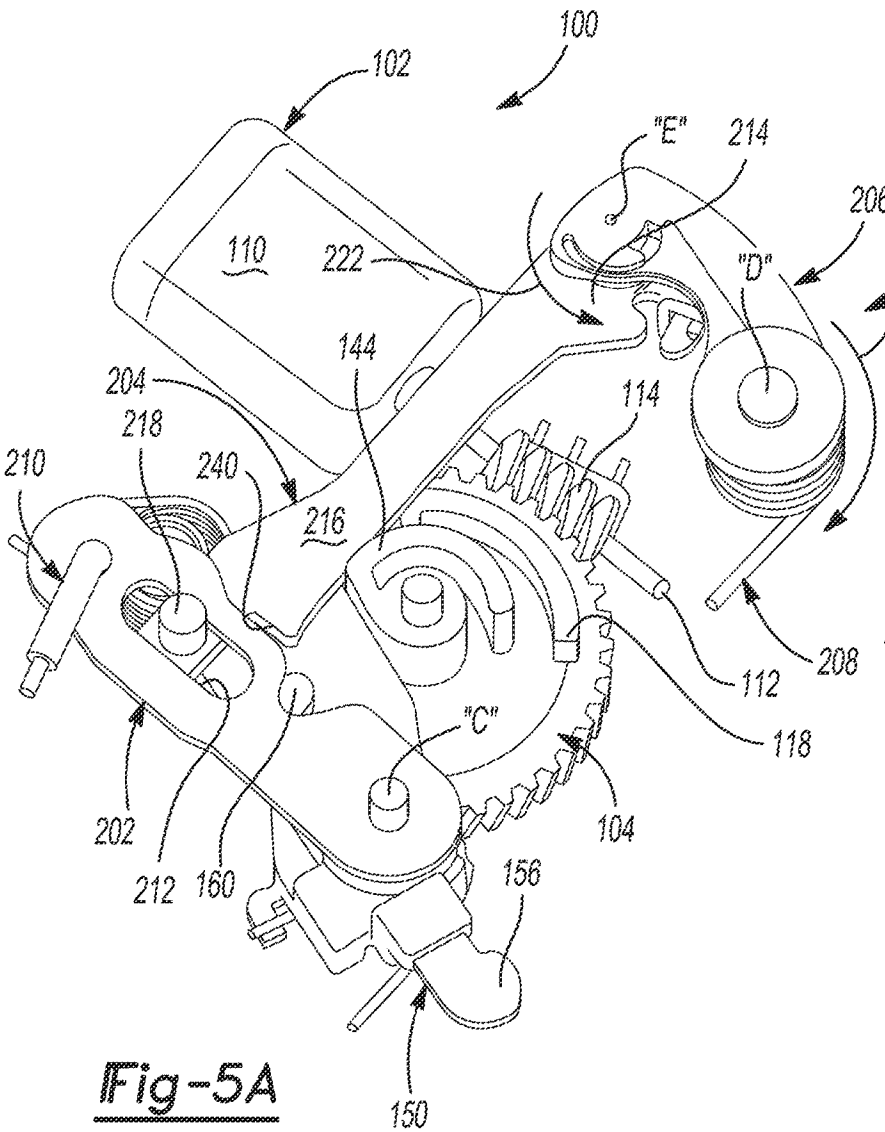

Referring to FIGS. 5A and 5B, components of inside handle release mechanism 200 are now shown built upon the components of power release mechanism 100 shown in FIGS. 4A and 4B, respectively. Inside handle release mechanism 200 generally includes an emergency lever 202, a link lever 204, an auxiliary lever 206, and an auxiliary lever spring 208. Emergency lever 202 is pivotably supported for movement about an actuator lever axis "C" from a first or "home" position to a second or "pulled" position in response to actuation of inside door handle 26 from a first or "rest" position to a second or "actuated" position. In this regard, an inside handle connection device 210 (i.e. cable, rod, linkage, etc.) is shown for mechanically interconnecting emergency lever 202 to inside door handle 26. Emergency lever 202 is also shown to include an elongated guide slot 212 formed therein. Auxiliary lever 206 is shown supported for pivoted movement about an auxiliary lever axis "D".

Link lever 204 is an elongated member having a first end segment 214 pivotably coupled to auxiliary lever 106 about a link lever pivot point "E", and a second end segment 216 having a drive post 218 disposed within guide slot 212 of emergency lever 202. Auxiliary lever spring 208 acts between a stationary component and link lever 204 to normally bias auxiliary lever 206 in a first direction (as indicated by arrow 220) into engagement with a stationary hard stop 230 (FIG. 6). This biasing causes a corresponding biasing in a first direction of link lever 204 about pivot point "E" (as indicated by arrow 220). As will be detailed, link lever 204 is pivotably moveable relative to pivot axis "E" between a first or "uncoupled" position and a second or "coupled" position. Auxiliary lever spring 208 also functions to bias an intermediate segment of link lever 204 into continuous engagement with link lever cam 144 on power release gear 104. As will be detailed, inside handle release mechanism 200 is defined as operating in a Disengaged State when link lever 204 is located in its uncoupled position and as operating in an Engaged State when link lever 204 is located in its coupled position.

Figure 6A:
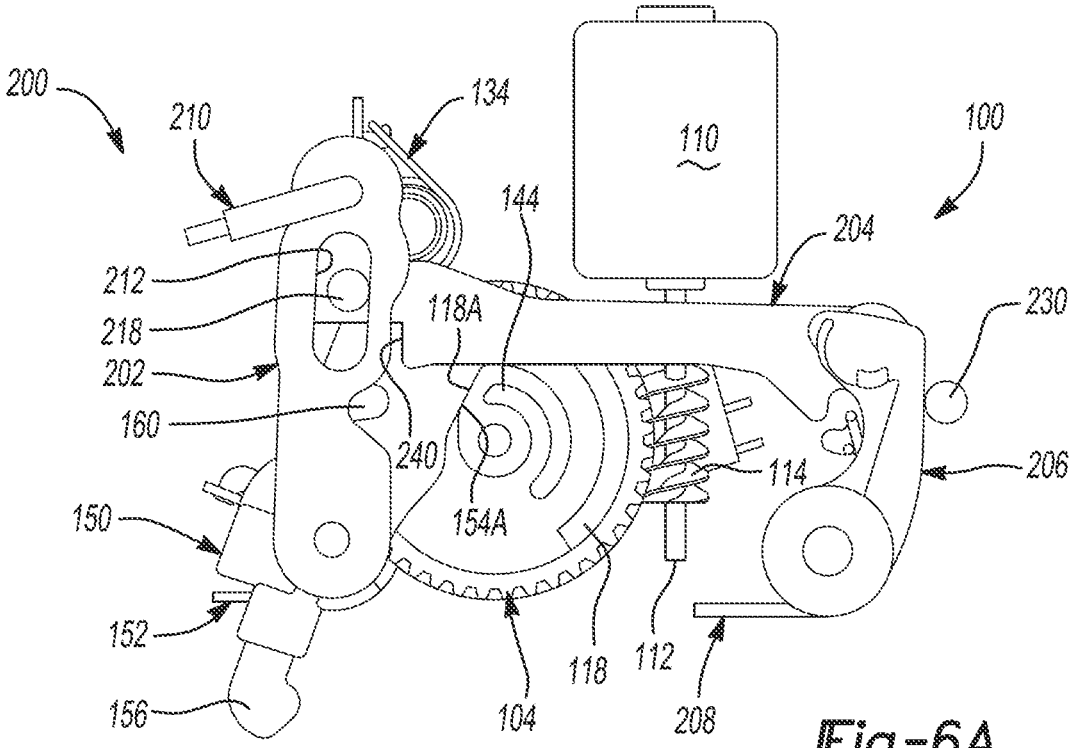
FIGS. 6A and 6B are top and bottom plan views illustrating the closure latch assembly in a Latched mode with the power release mechanism operating in a Neutral state and the inside handle release mechanism operating in a Disengaged state.
Figure 6B:
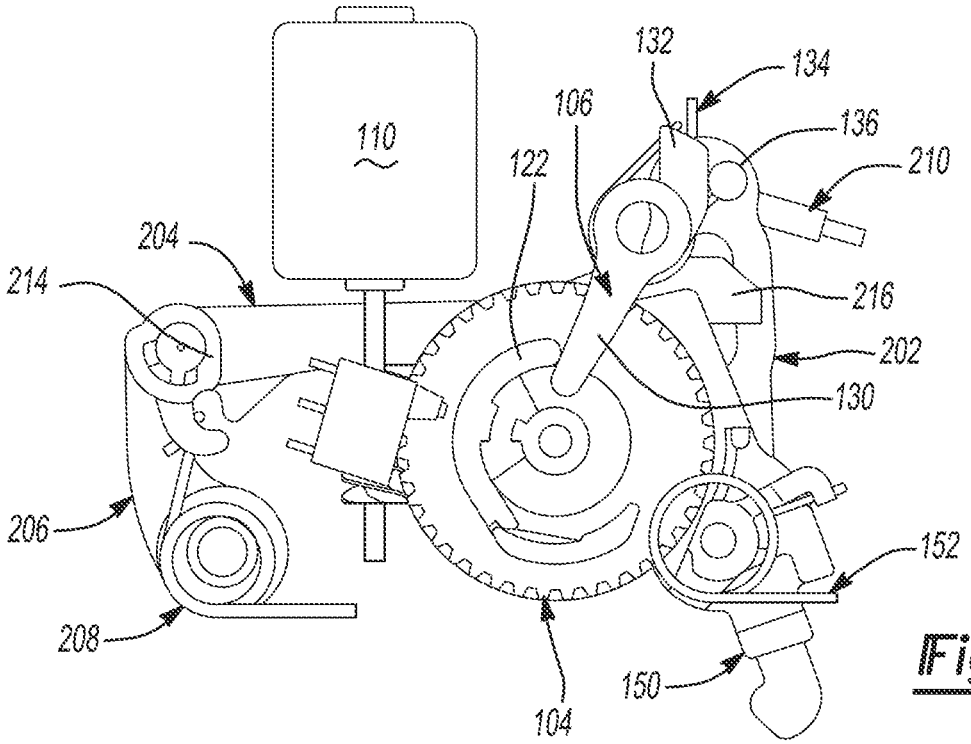

Referring now to FIGS. 6A and 6B, closure latch assembly 10 is shown in a Latched mode with power release mechanism 100 operating in its Neutral state and inside handle release mechanism 200 operating in its Disengaged state. To establish the Latched mode, the components are in the following positions: ratchet 30 is located in its striker capture position; pawl 32 is located in its ratchet holding position; power release gear 104 is located in its central-home position; actuator lever 150 is located in its non-actuated position; emergency lever 202 is located in its home position; link lever 204 is located in its uncoupled position; and inside door handle 26 is located in its rest position. As such, a cam edge 118A of release cam 118 is shown located adjacent to a cam edge 154A formed on plate segment 154 of actuator lever 150. With link lever 204 held by link lever cam 144 in its uncoupled position, a second drive member, hereinafter referred to as drive notch 240, formed on second end segment 216 of link lever 204 is positioned above drive lug 160 on plate segment 154 of actuator lever 150. FIG. 6B also illustrates drive lug segment 130 of gear lever 106 biased by gear lever spring 134 into engagement with an end portion of gear lever cam 122 on power release gear 104.

Figure 7A:
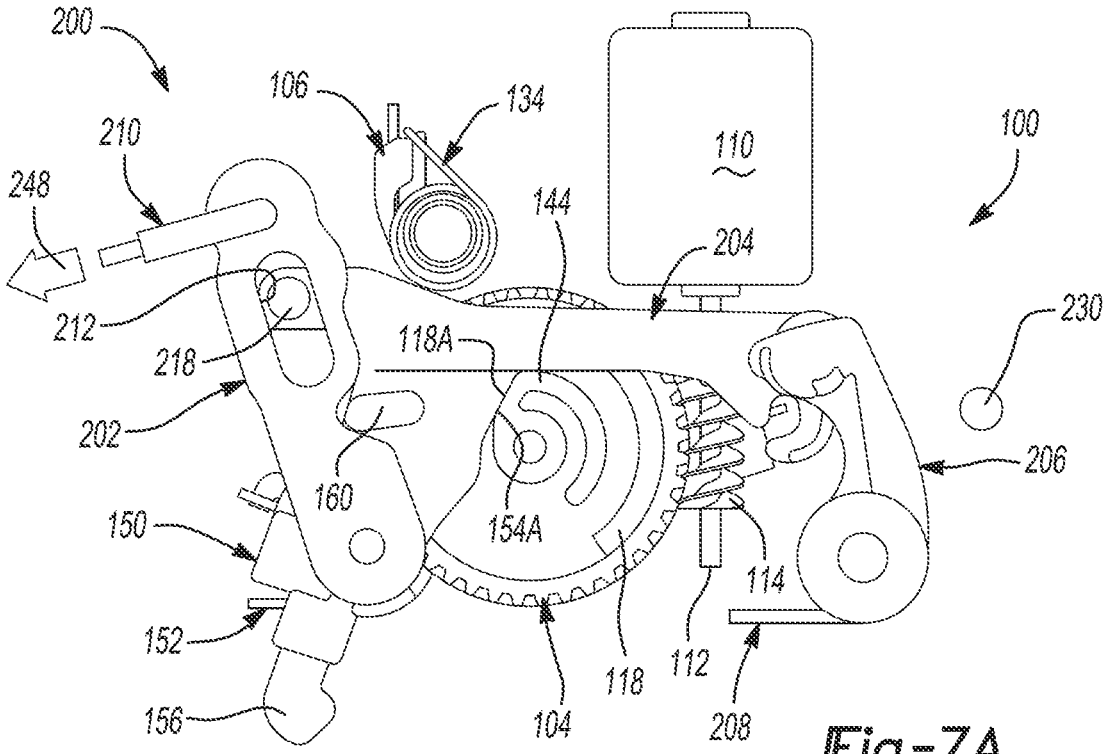
FIGS. 7A and 7B are top and bottom plan views, similar to FIGS. 6A and 6B, respectively, but now showing actuation of an inside door handle with the closure latch assembly maintained in its Latched mode.
Figure 7B:
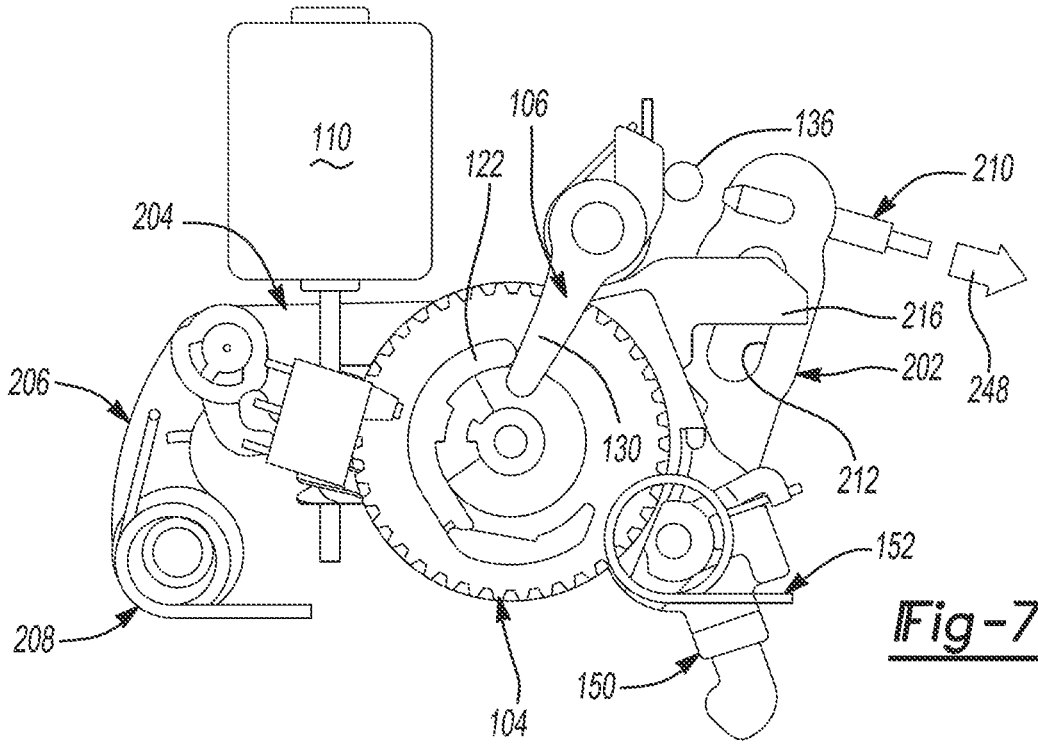

FIGS. 7A and 7B illustrate that link lever 204 remains disengaged or uncoupled from actuator lever 150 when inside door handle 26 is moved from its rest position into its actuated position, as indicated by arrow 248. Specifically, emergency lever 202 is shown moved via inside connection device 210 from its home position (FIGS. 5A, 5B) into its pulled position. However, link lever cam 144 on power release gear 104 continues to hold link lever 204 in its uncoupled position such that drive notch 240 on link lever 204 is not engaged with drive lug 160 on actuator lever 150. Thus, translational movement of link lever 204 in response to such pivotal movement of emergency lever 202 (due to retention of drive post 218 within guide slot 212) does not result in concurrent movement of actuator lever 150 out of its non-actuated position. As such, actuation of inside door handle 26 does not result in release of the latch mechanism and closure latch assembly 10 is maintained in its Latched mode.

Figure 8A:
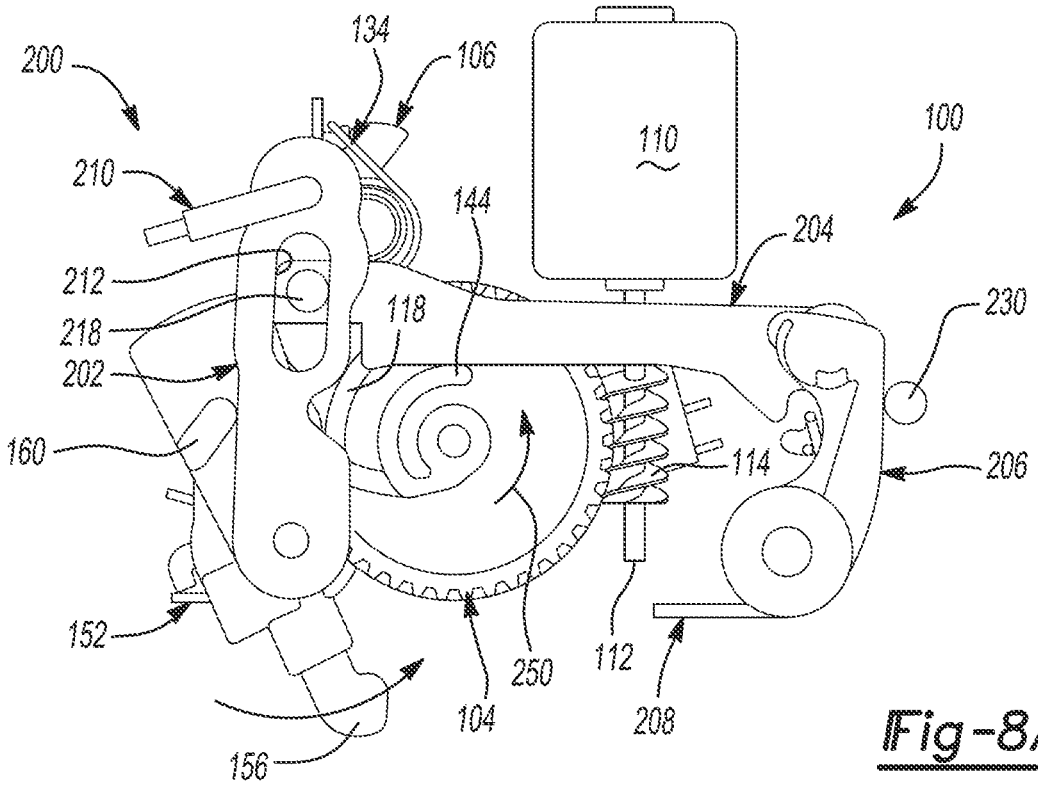
FIGS. 8A and 8B are top and bottom plan views, similar to FIGS. 6A and 6B, respectively, but now showing the closure latch assembly shifted into a Power Release mode via a power releasing operation with the power release mechanism operating in a Released state and the inside handle release mechanism maintained in its Disengaged state.
Figure 8B:
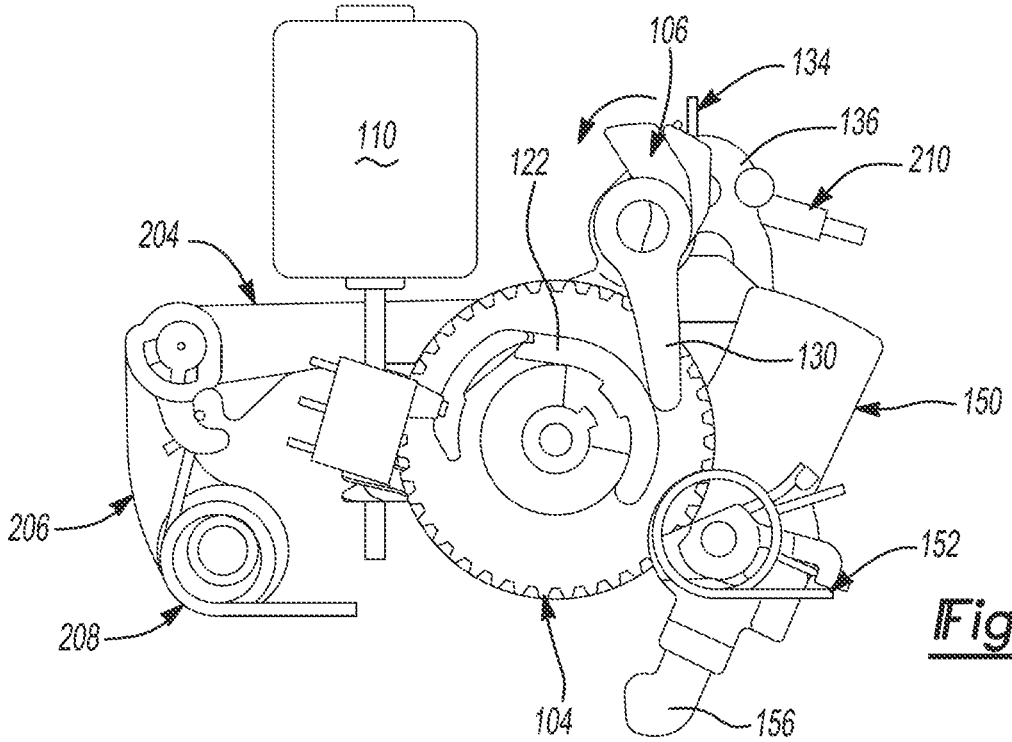

For showing the movement of the components associated with a power releasing function, reference is now directed to FIGS. 6A and 6B which illustrate closure latch assembly 10 operating in its Latched mode and to FIGS. 8A and 8B which illustrate closure latch assembly 10 operating in a Power Release mode. Specifically, when a power release operations of the latch mechanism is properly requested and ECU 60 determines that a full power condition is supplied to closure latch assembly 10, power release motor 110 is energized for rotating power release gear 104 in a power releasing direction (i.e., counterclockwise in FIG. 8A), as indicated by arrow 250, from its central-home position into its released position. Power release stop switch 140 is actuated when power release gear 104 is located in its released position. Such rotation of power release gear 104 causes cam edge 118A on release cam 118 to engage cam edge 154A on actuator lever 150 and forcibly pivot actuator lever 150 from its non-actuated position to its actuated position. This action results in movement of release lever 40 from its home position to its pawl release position for causing pawl 32 to move to from its ratchet holding position its ratchet releasing position, thereby releasing ratchet 30 to move from its striker capture position to its striker release position. Note that lever link cam 144 continues to hold link lever 204 in its uncoupled position while emergency lever 202 is maintained in its home position. Also note from FIG. 8B that rotation of power release gear 104 to its released position causes gear lever cam 122 to forcibly pivot gear lever 106 from its home position (FIG. 6B) to a loaded position, in opposition to the biasing of gear lever spring 134. Thus, FIGS. 8A and 8B illustrate power release mechanism 100 shifted from its Neutral state into a Released state while inside handle release mechanism 200 is maintained in its Disengaged state.

Figure 9A:
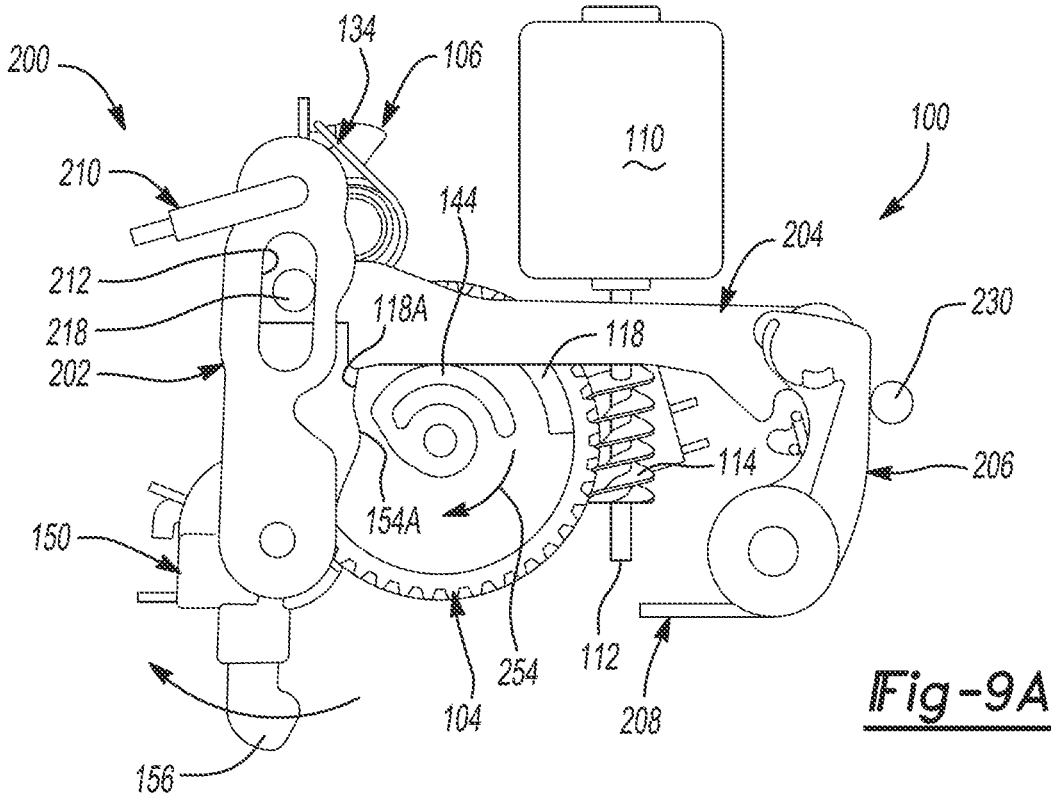
FIGS. 9A and 9B are top and bottom plan views generally similar to FIGS. 8A and 8B, respectively, but now showing the power release mechanism of the closure latch assembly being reset following completion of the power releasing operation.
Figure 9B:
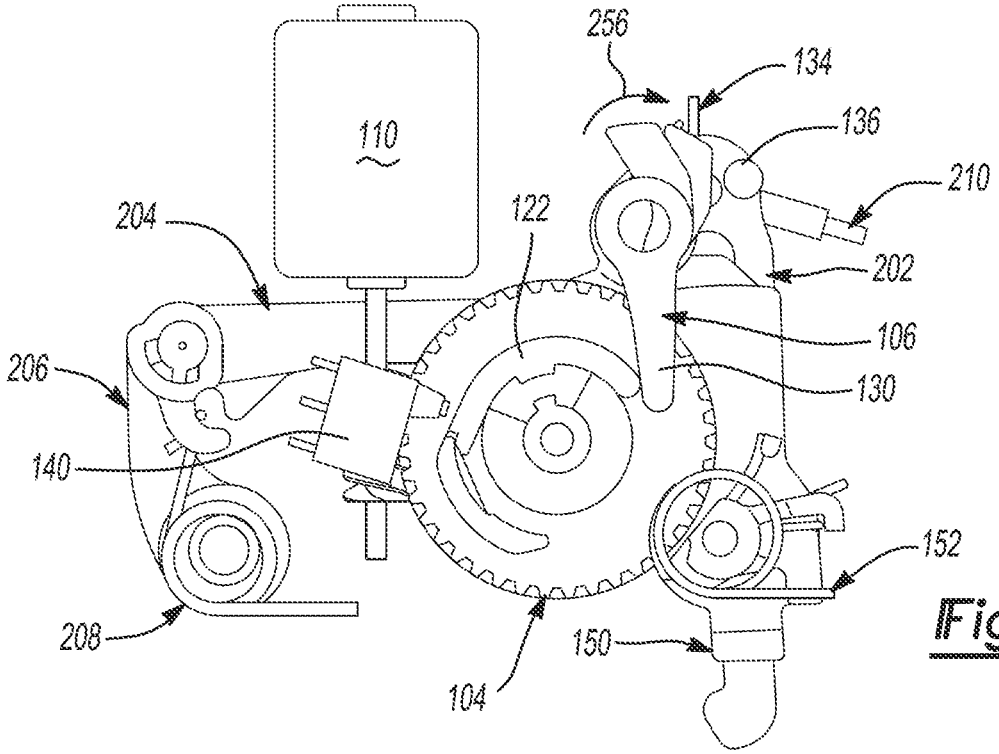
Figure 10A:
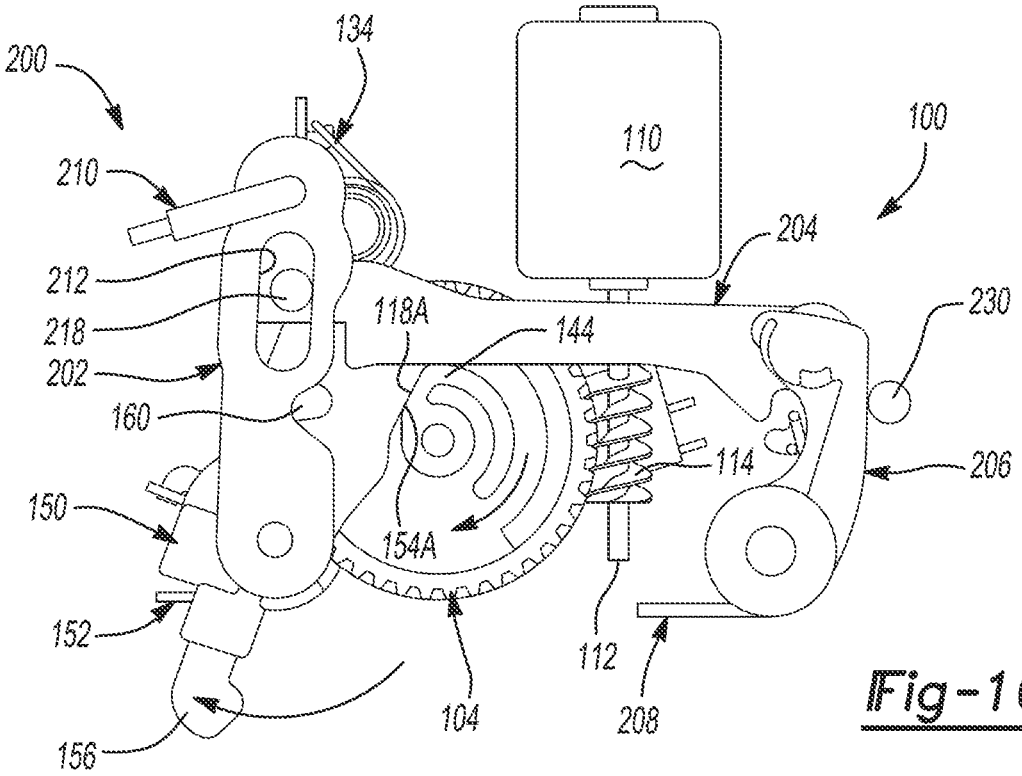
FIGS. 10A and 10B are top and bottom plan views generally similar to FIGS. 9A and 9B, respectively, but now showing completion of the power resetting operation.
Figure 10B:
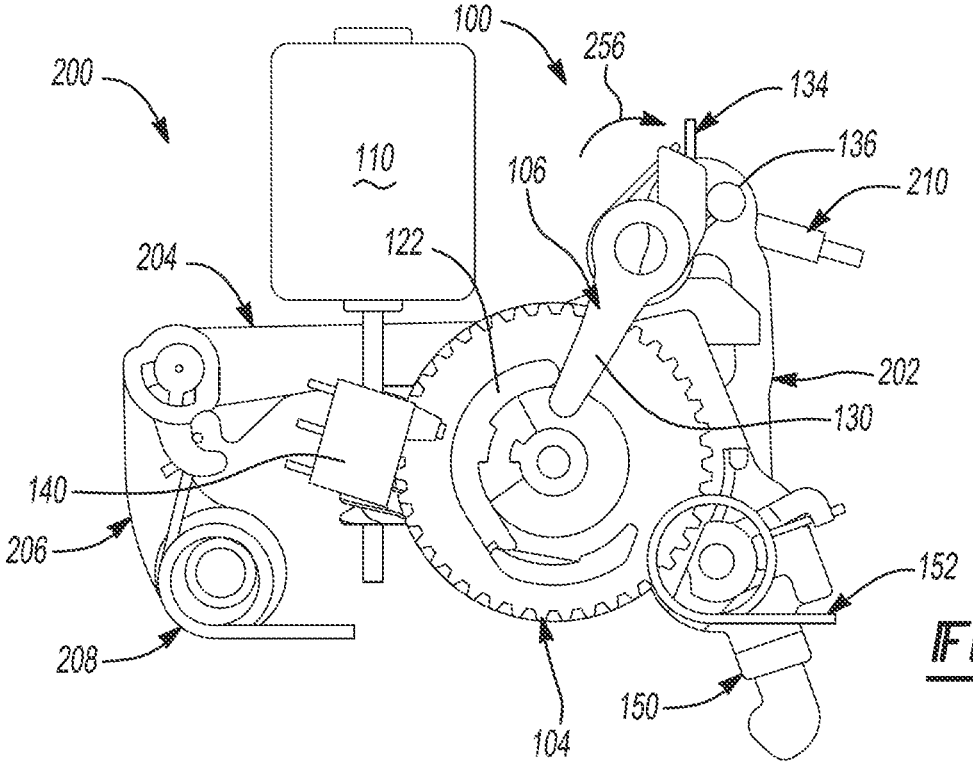

FIGS. 9A and 9B illustrate a subsequent shifting of closure latch assembly 10 from its Power Release mode (FIGS. 8A, 8B) into a Power Reset mode. Specifically, power release motor 110 is reversed in response to ECU 60 receiving the position signal from switch 140 and drives power release gear 104 in a power resetting (i.e., clockwise in FIG. 9A) direction, as indicated by arrow 254, from its released position back into its central-home position. This action allows actuator lever spring 152 to return actuator lever 150 to its non-actuated position while link lever cam 144 continues to hold link lever 204 in its uncoupled position. As best indicated by arrow 256 in FIG. 9B, gear lever spring 134 forcibly rotates gear lever 106 from its loaded position toward its home position, thereby causing drive lug segment 130 to act on gear lever cam 122 and forcibly assist in rotating power release gear 104 back to its central-home position. Power release motor 110 is stopped when sensor 140 is released to change status such that spring-loaded gear lever 106 functions to physically return power release gear 104 completely to its central-home position, as indicated by FIGS. 10A and 10B. Thus, with closure latch assembly 10 shifted into its Power Release mode, power release mechanism 100 is operating in a Resetting state while inside handle release mechanism 200 remains in its Disengaged state.

Figure 11A:
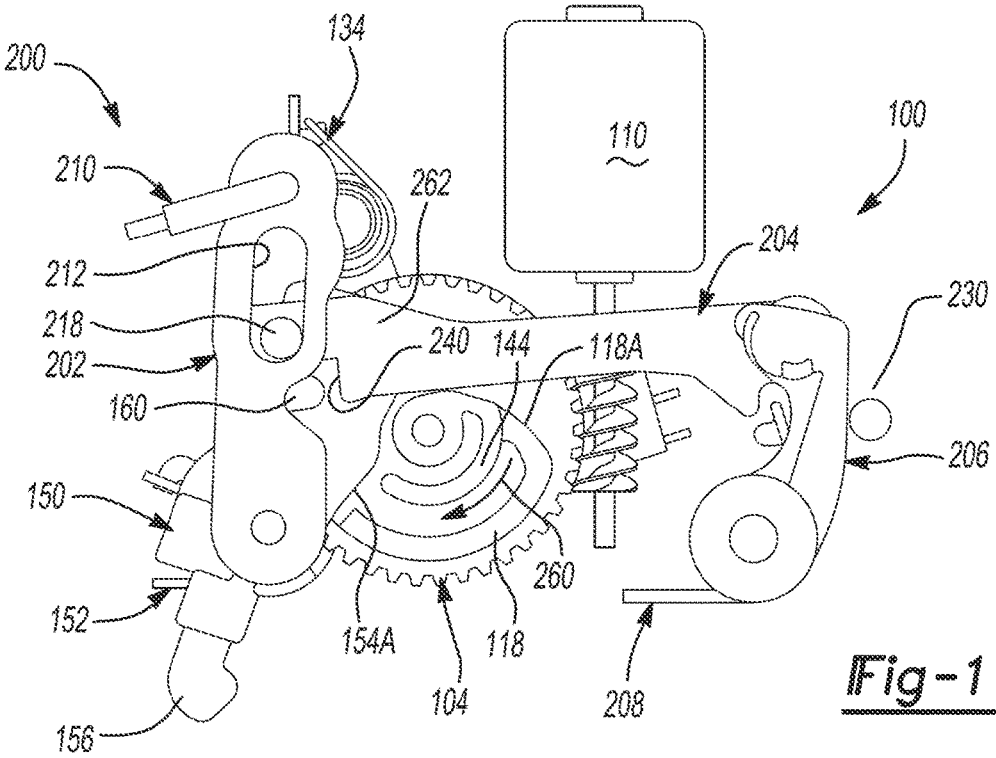
FIGS. 11A and 11B are top and bottom plan views generally similar to FIGS. 6A and 6B, respectively, now showing the closure latch assembly shifted into an Emergency Release mode with the power release mechanism operating in an Unlocked state and the inside handle release mechanism operating in an Engaged state.
Figure 11B:
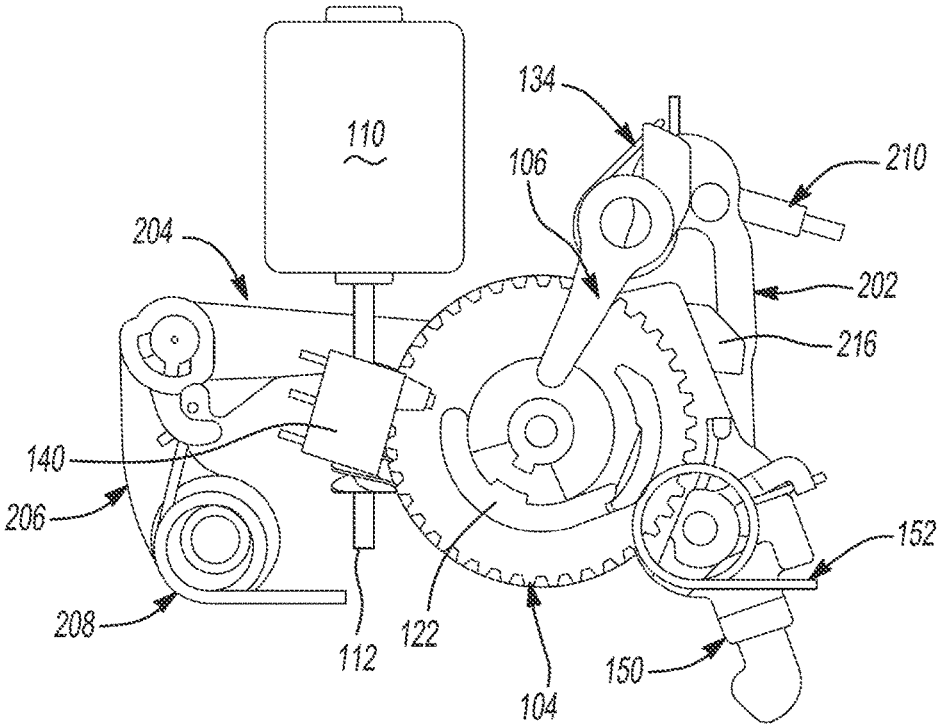

For showing the movement of the components associated with an emergency releasing function, reference is directed to FIGS. 6A and 6B which illustrate closure latch assembly 10 in its Latched mode and FIGS. 11A and 11B which illustrate closure latch assembly 10 now operating in an Emergency Release mode. Specifically, under certain low power and/or emergency situations, an emergency release of the latch mechanism is permitted by ECU 60 initially supplying power release motor 110 with electrical power from a backup power source such as, for example, an internal reserve (i.e., super capacitors). This emergency power is used to cause power release motor 110 to rotate power release gear 104 in an unlocking direction from its central-home position (FIG. 6A) to its unlocked position, as indicated by arrow 260. Such rotation of power release gear 104 causes link lever 204 to disengage link lever cam 144 such that link lever 204 is biased by auxiliary lever spring 208 to pivot from its uncoupled position (FIG. 6A) to its coupled position (FIG. 11A). With link lever 204 located in its coupled position, drive lug 160 on actuator lever 150 is aligned with drive notch 240 on link lever 204, as shown in circle 262.

Figure 12A:
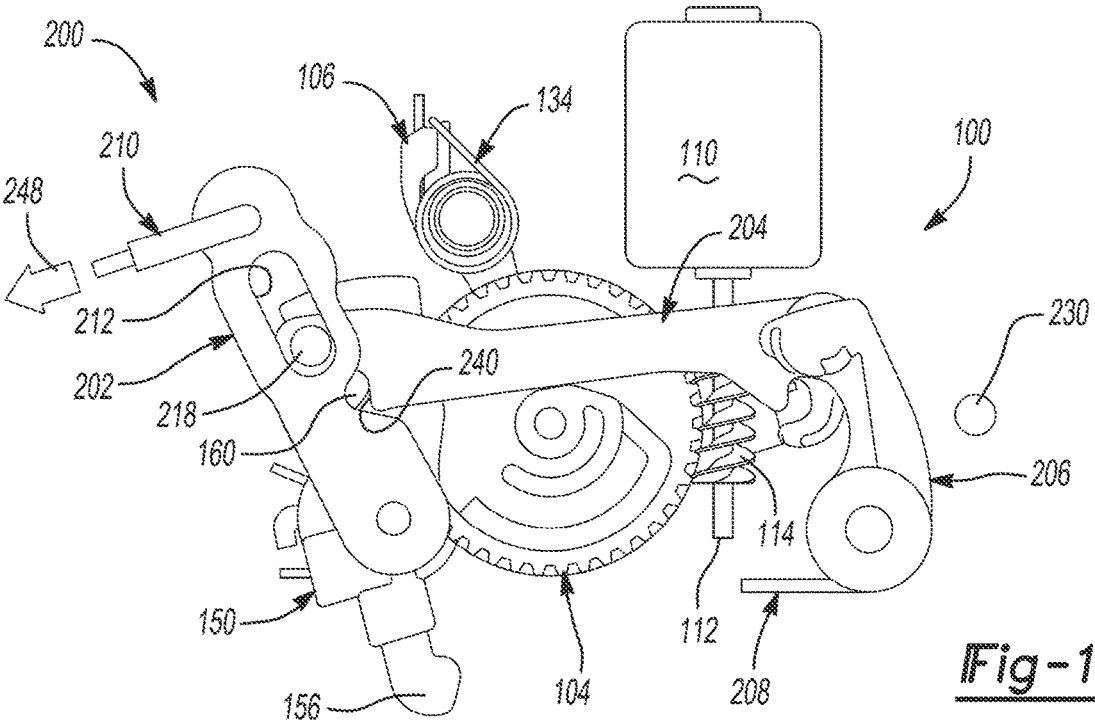
FIGS. 12A and 12B are top and bottom plan views generally similar to FIGS. 11A and 11B, respectively, but now showing actuation of the inside handle causing manual release of the closure latch assembly.
Figure 12B:
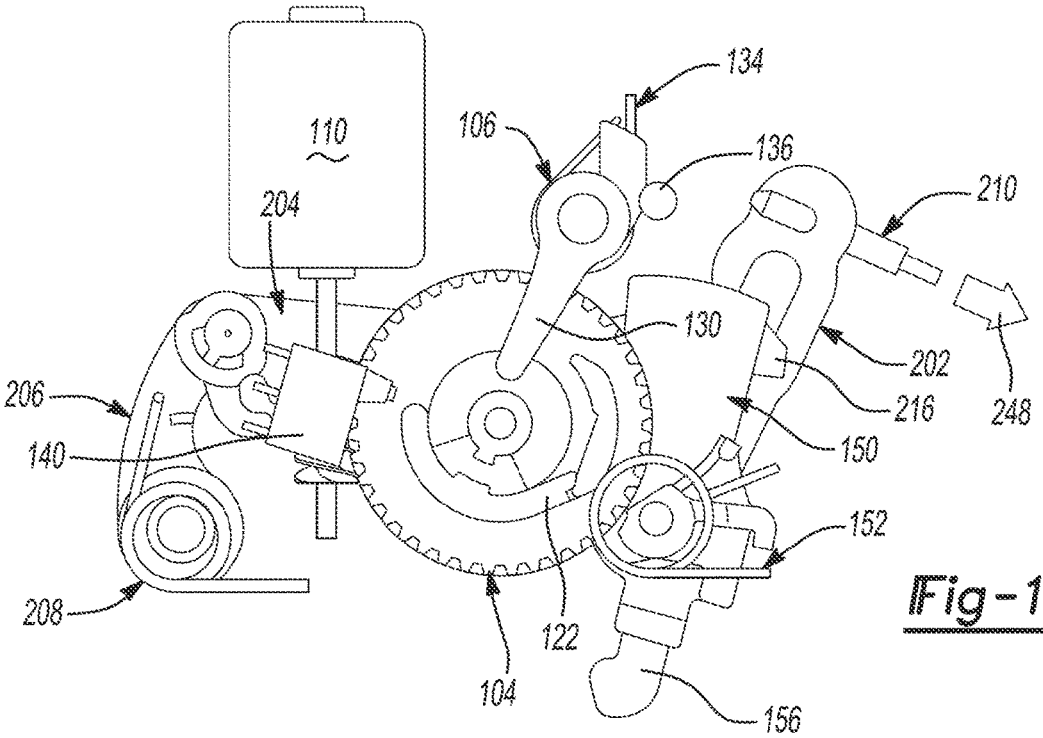

As seen, actuator lever 150 is still located in its non-actuated position and emergency lever 202 is still located in its home position after power release gear 104 has been rotated to it unlocked position. As such, power release mechanism 100 is operating in its Unlocked state and inside handle release mechanism 200 is operating in its Engaged state. FIGS. 12A and 12B illustrate that subsequent movement of inside door handle 26 from its rest position to its actuated position causes mechanical movement of emergency lever 202 from its home position into its pulled position. Since link lever 204 is now connected to emergency lever 202, via drive post 218 within guide slot 212 and drive lug 160 being aligned with drive notch 240, such pivotal movement of emergency lever 202 to its pulled position results in concurrent pivotal movement of actuator lever 150 from its non-actuated position into its actuated position. This movement of actuator lever 150 results in manual release of the latch mechanism for shifting closure latch assembly 10 into its Unlatched mode, thereby allowing door 12 to be opened. Closure latch assembly 10 may subsequently be reset manually or electrically by rotating power release gear 104 from its unlocked position back to its central-home position after inside door handle 26 has been released and actuator lever 150 has returned to its non-actuated position.

Thus, the present disclosure provides a closure latch assembly configured to normally disconnect/uncouple the inside handle release mechanism 200 from the latch release mechanism utilizing the power release mechanism 100 until a crash or low power situation occurs which requires subsequent connection/coupling of inside handle release mechanism 200 to the latch release mechanism. During normal latch operation, inside latch release mechanism 200 is intentionally disabled/uncoupled to prevent unintended inside latch release operations. The internal power reserve (i.e., onboard batteries, super capacitors, etc.) are only used to enable/couple inside latch release mechanism 200, and particularly a three (3) position power release gear 104 and camming arrangement, is an advancement over otherwise conventional systems. While not limited thereto, specific conditions under which the emergency inside release function is provided include: 1) in event of crash with the vehicle battery disconnected or interrupted; 2) in case of a failed power release operation; 3) in case of the internal energy reserve being under a predetermined minimum reserve power level and the vehicle battery is disconnected; and 4) in the event of a soft closing/cinching operation failure. It will also be understood that actuator lever 150 could be configured to act directly on pawl 32 instead of through the intermediate latch release mechanism in other applications such that movement of actuator lever 150 between its non-actuated and actuated positions causes corresponding movement of pawl 32 between its ratchet holding and ratchet releasing positions.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of illustrative embodiments thereof, it can be modified, without departing from the scope of the subject invention as defined in the appended claims.

What is claimed is:

1. A closure latch assembly for a vehicle door, comprising:

a latch mechanism including a ratchet and a pawl, the ratchet being moveable between a striker release position and a striker capture position, the pawl being moveable between a ratchet holding position whereat the pawl holds the ratchet in its striker capture position and a ratchet releasing position whereat the pawl permits the ratchet to move to its striker release position;

a power release mechanism including a power release motor, a power release gear driven by the power release motor, and an actuator lever, the actuator lever being moveable between a non-actuated position whereat the pawl is maintained in its ratchet holding position and an actuated position whereat the actuator lever moves the pawl to its ratchet releasing position, the power release gear being rotatable in a releasing direction from a central-home position to a released position for causing the actuator lever to move from its non-actuated position into its actuated position, and the power release gear being rotatable in an unlocking direction from its central-home position to an unlocked position; and an inside handle release mechanism including a link lever operatively connected to an inside door handle and moveable between an uncoupled position when the power release gear is located in its central-home position and a coupled position when the power release gear is located in its unlocked position, the link lever being disconnected from the actuator lever when located in its uncoupled position and being connected to the actuator lever when located in its coupled position.

2. The closure latch assembly of claim 1, wherein a release cam on the power release gear is operable to move the actuator lever from its non-actuated position into its actuated position in response to rotation of the power release gear from its central-home position into its released position for providing a power releasing function.

3. The closure latch assembly of claim 2, wherein subsequent rotation of the power release gear in a resetting direction from its released position to its central-home position permits the actuator lever to move from its actuated position into its non-actuated position for providing a power resetting function.

4. The closure latch assembly of claim 1, wherein a link lever cam on the power release gear is operable to hold the link lever in its uncoupled position when the power release gear is located in its central-home and released positions and is operable to permit the link lever to move to its coupled position when the power release gear is located in its unlocked position.

5. The closure latch assembly of claim 4, wherein a first engagement feature on the actuator lever is released from engagement with a second engagement feature on the link lever when the link lever cam on the power release gear holds the link lever in its uncoupled position such that the link lever is disconnected from the actuator lever and movement of the inside door handle from a rest position to an actuated position does not result in movement of the actuator lever from its non-actuated position to its actuated position, and wherein the first engagement feature on the actuator lever is engaged with the second engagement feature on the link lever when the link lever cam permits the link lever to move to its coupled position such that the link lever is connected to the actuator lever and movement of the inside door handle from its rest position to its actuated position results in corresponding movement of the actuator lever from its non-actuated position to its actuated position.

6. The closure latch assembly of claim 5, wherein the inside handle release mechanism operates in a Disengaged state when the power release gear is located in its central-home position and the link lever cam holds the link lever in its uncoupled position, and wherein the inside handle release mechanism operates in an Engaged state when the power release gear is located in its unlocked position and the link lever cam permits the link lever to move to its coupled position.

7. The closure latch assembly of claim 6, wherein movement of the inside door handle from its rest position to its actuated position when inside handle release mechanism in its Engaged state causes corresponding movement of the link lever for driving the actuator lever from its non-actuated position to its actuated position for manually releasing the latch mechanism.

8. The closure latch assembly of claim 1, wherein the power release gear is only rotated from its central-home position to its unlocked position by electrical power provided by a reserve power supply.

9. A closure latch assembly for a vehicle door, comprising:

a latch mechanism including a ratchet and a pawl, the ratchet being moveable between a striker release position and a striker capture position, the pawl being moveable between a ratchet holding position whereat the pawl holds the ratchet in its striker capture position and a ratchet releasing position whereat the pawl permits the ratchet to move to its striker release position;

a power release mechanism including a power release motor, a power release gear driven by the power release motor and operably coupled to the pawl, the power release gear being rotatable in a releasing direction for causing the pawl to move from its ratchet holding position to its ratchet releasing position, and the power release gear being rotatable in an unlocking direction; and a handle release mechanism including a link lever, the link lever being operatively connected to an inside door handle and moveable between a home position and a pulled position in response to movement of the inside door handle between a rest position and an actuated position, the link lever moveable between an uncoupled position and a coupled position by the power release gear, wherein the link lever is operably disconnected from the pawl when located in its uncoupled position and is operably connected with the pawl when located in its coupled position in response to rotation of the power release gear in the unlocking direction.

10. The closure latch assembly of claim 9, wherein the link lever is biased towards the coupled position.

11. The closure latch assembly of claim 9, wherein the link lever is pivotally moveable about a pivot point.

12. The closure latch assembly of claim 11, wherein the link lever is further configured to translate from a home position to a pulled position in response to actuation of the inside door handle.

13. The closure latch assembly of claim 9, wherein the power release gear comprises a release cam operable to move the pawl in response to rotation of the power release gear in the releasing direction.

14. The closure latch assembly of claim 9, further comprising a link lever cam operable when the power release gear is in a home position to hold the link lever in its uncoupled position and operable when the power release gear is in an unlocking position to permit the link lever to move to its coupled position.

15. The closure latch assembly of claim 9, wherein the power release gear comprises a release cam operable to move the pawl in response to rotation of the power release gear in the releasing direction, wherein rotation of the power release gear rotates a link lever cam operable to hold the link lever in its uncoupled position when the power release gear is located in a home position and operable to permit the link lever to move to its coupled position when the power release gear is rotated in the unlocking direction to an unlocked position, and wherein the release cam and the link cam are positioned about the axis of the power release gear.

16. The closure latch assembly of claim 9, further comprising an actuator lever operably coupled to the pawl, the actuator lever being moveable between a non-actuated position whereat the pawl is maintained in its ratchet holding position and an actuated position whereat the actuator lever moves the pawl to its ratchet releasing position, wherein the power release gear is rotatable in the releasing direction from a home position to a released position for causing the actuator lever to move from its non-actuated position into its actuated position.

17. The closure latch of claim 16, wherein the link lever comprises a first drive member and the actuator lever comprises a second drive member, wherein the first drive member and the second drive member are aligned when the link lever is in the coupled position and the first drive member and the second drive member are misaligned when the link lever is in the decoupled position.

18. The closure latch assembly of claim 14, wherein the link lever is in continuous engagement with the link lever cam.

19. The closure latch assembly of claim 9, wherein the power release motor rotates the power release gear in the unlocking direction in response to the occurrence of an emergency condition.

20. The closure latch assembly of claim 19, wherein the emergency condition is one of a crash condition, a lower power condition, a disconnection of the vehicle battery condition, an interruption of the vehicle battery condition, a low backup source power condition, or a failed power release operation.

21. The closure latch assembly of claim 9, wherein the power release gear comprises: a central home position, wherein when the power release gear is in the central home position the link lever is maintained in the uncoupled position and the pawl is maintained in the ratchet holding position; a released position, wherein when the power release gear is in the released position the link lever is maintained in the uncoupled position and the pawl is moved to the ratchet releasing position; and an unlocked position, wherein when the power release gear is in the unlocked position the link lever is in the uncoupled position and the pawl is maintained in the ratchet holding position.

22. The closure latch assembly of claim 9, wherein the power release motor is controlled by a controller in communication with a switch associated with an outside handle.

23. The closure latch assembly of claim 9, wherein the power release motor is controlled during an emergency condition to rotate the power release gear in the unlocking direction using power from a backup power source.

24. The closure latch assembly of claim 9, wherein the power release motor is controlled during an emergency condition to rotate the power release gear in the unlocking direction to an unlocked position using power from a supercapacitor provided internal the closure latch assembly.

25. The closure latch assembly of claim 9, further comprising a biased pivot gear lever moveable from a home position to a loaded position in response to rotation of the power release gear in the releasing direction, wherein the pivot gear lever in the loaded position urges the power release gear in the unlocking direction.

26. The closure latch assembly of claim 25, wherein the power release gear comprises a gear lever cam for forcibly pivoting the gear lever in response to rotation of the power release gear in the releasing direction.

27. A method of operating a closure latch assembly comprising a power release mechanism having a power release motor and a power release gear, a ratchet and a pawl for holding the ratchet, and a link lever moveable by an inside door handle from a home position to a pulled position in response to movement of the inside door handle from a rest position to an actuated position, the link lever having an uncoupled position wherein the link lever is operably disconnected from the pawl and a coupled position wherein the link lever is operably connected with the pawl, the method comprising:

controlling the power release motor to rotate the power release gear in a releasing direction for causing the pawl to move from a ratchet holding position to a ratchet releasing position to release the closure latch assembly; and controlling the power release motor in response to detection of an emergency condition to rotate the power release gear in an unlocking direction for causing the link lever to move from the uncoupled position to the coupled position, wherein the link lever in the coupled position allows movement of the inside door handle from the rest position to the actuated position to move the pawl from the ratchet holding position to the ratchet releasing position.

* * * * *